US011806637B2

(12) United States Patent
Frawley

(10) Patent No.: US 11,806,637 B2
(45) Date of Patent: Nov. 7, 2023

(54) TRANSFORMING TOY ROCKET

(71) Applicant: Sean Michael Frawley, Hung Hom (HK)

(72) Inventor: Sean Michael Frawley, Hung Hom (HK)

( * ) Notice: Subject to any disclaimer, the term of this patent is extended or adjusted under 35 U.S.C. 154(b) by 316 days.

(21) Appl. No.: 17/339,922

(22) Filed: Jun. 4, 2021

(65) Prior Publication Data

US 2022/0331707 A1 Oct. 20, 2022

Related U.S. Application Data

(63) Continuation-in-part of application No. 29/778,664, filed on Apr. 14, 2021.

(51) Int. Cl.
*A63H 27/00* (2006.01)
*A63H 27/14* (2006.01)

(52) U.S. Cl.
CPC ..... *A63H 27/005* (2013.01); *A63H 27/14* (2013.01)

(58) Field of Classification Search
CPC ..... A63H 27/005; A63H 27/14
See application file for complete search history.

(56) References Cited

U.S. PATENT DOCUMENTS 1,635,823 A * 7/1927 Di Giulio ..... B64D 17/00 244/140
3,188,768 A * 6/1965 Boswell ..... A63H 5/04 446/45
3,397,481 A * 8/1968 Boese ..... A63H 27/005 446/52
3,465,472 A * 9/1969 Novotny ..... A63H 27/005 446/52
3,965,611 A * 6/1976 Pippin, Jr. ..... F42B 12/60 446/211
4,295,290 A * 10/1981 Boswell ..... A63H 27/005 446/212
4,840,598 A * 6/1989 Schuetz ..... A63F 9/0278 446/52
4,913,675 A * 4/1990 Wilcox ..... A63H 27/005 446/65
5,306,191 A * 4/1994 Phillips ..... A63H 27/005 446/61
5,407,375 A * 4/1995 Johnson ..... A63H 27/14 446/52
5,413,514 A * 5/1995 Milligan ..... A63H 27/007 446/211

(Continued)

FOREIGN PATENT DOCUMENTS

CN 108452534 A 8/2018
CN 210583656 U * 5/2020

*Primary Examiner* — Eugene L Kim
*Assistant Examiner* — Alyssa M Hylinski
(74) *Attorney, Agent, or Firm* — QUICKPATENTS, LLC; Kevin Prince

(57) ABSTRACT

A propeller-driven rocket has a body that is divided into multiple pieces. During the launch and climb, the body reaction to the torque of the propeller keeps the body panels pressed into their initial orientation. At the apex of flight, or a predetermined time from launch, the propeller reverses direction for short period of time. This reverses the forces on the body panels, causing them to release outward. The body panels are hinged such that they may form a rotor for an auto-rotating, controlled descent.

16 Claims, 7 Drawing Sheets

(56) References Cited

U.S. PATENT DOCUMENTS

| | | | | |
|---|---|---|---|---|
| 5,951,354 | A * | 9/1999 | Johnson | A63H 27/14 446/52 |
| 6,478,648 | B1 * | 11/2002 | Applewhite | A63H 33/20 446/52 |
| 2004/0200924 | A1 * | 10/2004 | Clark, Jr. | A63H 27/12 244/7 B |
| 2010/0120321 | A1 * | 5/2010 | Rehkemper | A63H 27/12 446/36 |
| 2018/0057145 | A1 * | 3/2018 | Sartorius | B64C 11/04 |

* cited by examiner

TRANSFORMING TOY ROCKET

CROSS-REFERENCE TO RELATED APPLICATIONS

This application claims the benefit of U.S. Design Patent Application 29/778,664, filed on Apr. 15, 2021, and is incorporated herein by reference.

STATEMENT REGARDING FEDERALLY SPONSORED RESEARCH AND DEVELOPMENT

Not Applicable.

FIELD OF THE INVENTION

This invention relates to toy rockets, and more particularly to a toy rocket having body members that transform to provide a controlled descent propeller.

BACKGROUND

Previous propeller-driven rockets have used a tumbling recovery, or a secondary motor mechanism to deploy a parachute. Chemical driven rockets use a secondary charge to deploy parachutes or rotors.

U.S. Pat. No. 5,407,375 describes a toy rocket with a velocity dependent chute release. An elongated hatch is hingedly attached to the fuselage and is movable at its hinged attachment between a first position covering the cavity and constraining the parachute therein and a second position displaced from and opening up the cavity for deployment of the parachute. A latch mechanism releasably secures the hatch in its closed position. A trigger assembly includes a flap that is presented to the wind during flight of the rocket and that has a first position securing the latch mechanism and a second position releasing the latch mechanism to open the hatch. The flap is oriented such that the force of the impinging wind urges the flap to its first position. The latch is spring biased toward its second position with a biasing force chosen to move the flap to its second position when the force of the wind on the flap falls below a predetermined value thus releasing and deploying the parachute when the rocket slows to a selected speed.

U.S. Pat. No. 6,478,648 describes a rocket having a body with a bay therein and hatch which is movable between a bay opened position and a bay closed position by a spring biased hinge. The hatch is coupled to a two stage catch. A parachute is mounted to the hatch. Upon initial movement of the rocket the hatch is partially unlatched, then upon the near completion of forward movement, the latch completely releases the hatch so as to pull the parachute from the bay for deployment.

U.S. Pat. No. 3,465,472 describes an aerial toy simulating a rocket missile adapted to be catapulted substantially vertically upward into the air, deploying a parachute or rotors at a predetermined time somewhere in its trajectory to slow its descent.

Each of these conventional devices uses a descent slowing mechanism that is stuffed into the body of the rocket and deployed by various mechanisms.

Therefore, there is a need for a device that does not require a separate descent slowing device that is disposed inside the body of the rocket for slowing its descent. Further, there is a need for a device that does not require a secondary motor or charge for deploying the descent slowing device. The present invention accomplishes these objectives.

SUMMARY OF THE INVENTION

Embodiments of the present device provide a rocket that includes a propeller at a lower end thereof. A base assembly supports the propeller. A motor is disposed in the base assembly, where the motor is operable to turn the propeller to provide a force to propel the rocket, typically in an upward direction.

A nosepiece is connected to the base assembly with an elongated connector. A plurality of body pieces are disposed between the nosepiece and the base assembly. In some embodiments, the body pieces may cover all or some of the nosepiece and the base assembly when the body pieces are in the stowed or launch position. The plurality of body pieces are movable between a first position (the stowed or launch position), with each of the plurality of body pieces disposed adjacent the elongated connector 60 to form a rocket-shape, and a second position, with each of the plurality of body pieces disposed at an angle away from the nosepiece. At least one fin extends outward from each of the plurality of body pieces, wherein each fin is angled relative to horizontal (when the body pieces are deployed in the second position) to cause the rocket to rotate during descent when in the second position.

The motor turns in a first direction, creating the force to propel the rocket, where the first direction maintains the plurality of body pieces in the first position. The motor is operable to turn in a second direction, which provides torque to permit the plurality of body pieces to deploy into the second position.

The invention is a propeller-driven rocket with a body divided into multiple pieces. During the launch and climb, the body reaction of the torque of the propeller keeps the body panels pressed into their initial orientation. At the apex of flight, or a predetermined time from launch, the propeller reverses direction for short period. This reverses the forces on the body panels, causing them to release. The body panels are hinged such that they may form a rotor for an autorotating descent. The rocket does not require a separate descent slowing mechanism that is stowed in the body of the rocket. Further, the main motor drives the release of the descent slowing mechanism, thus removing the need for any additional motor or release mechanism/chemical reaction to cause the deployment of the descent slowing mechanism.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
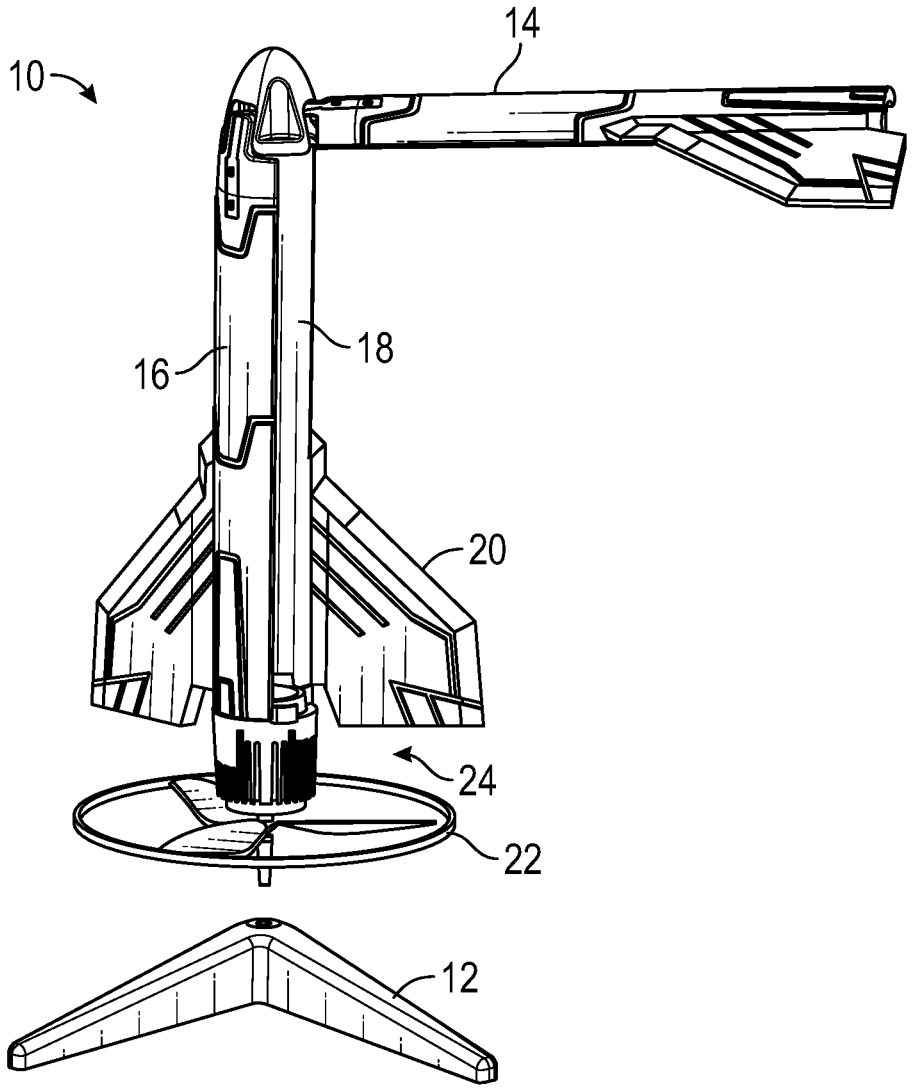
FIG. 1 is side perspective view of a rocket, having one body panel in a deployed position, according to an exemplary embodiment of the present invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Referring to FIGS. 1 through 5, a rocket 10 includes a propeller 22 at a lower end thereof. A base assembly 24 supports the propeller 22. A motor 32 is disposed in the base assembly, where the motor 32 is operable to turn the propeller 22 to provide a force to propel the rocket 10, typically in an upward direction.

Figure 6:
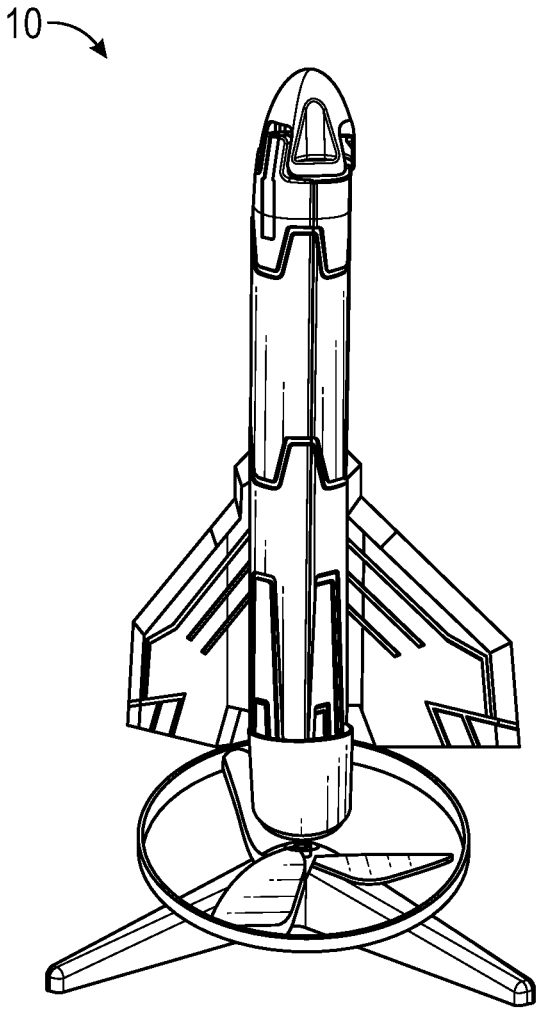
FIG. 6 is a perspective view of the rocket of FIG. 1, ready for launch.
Figure 7:
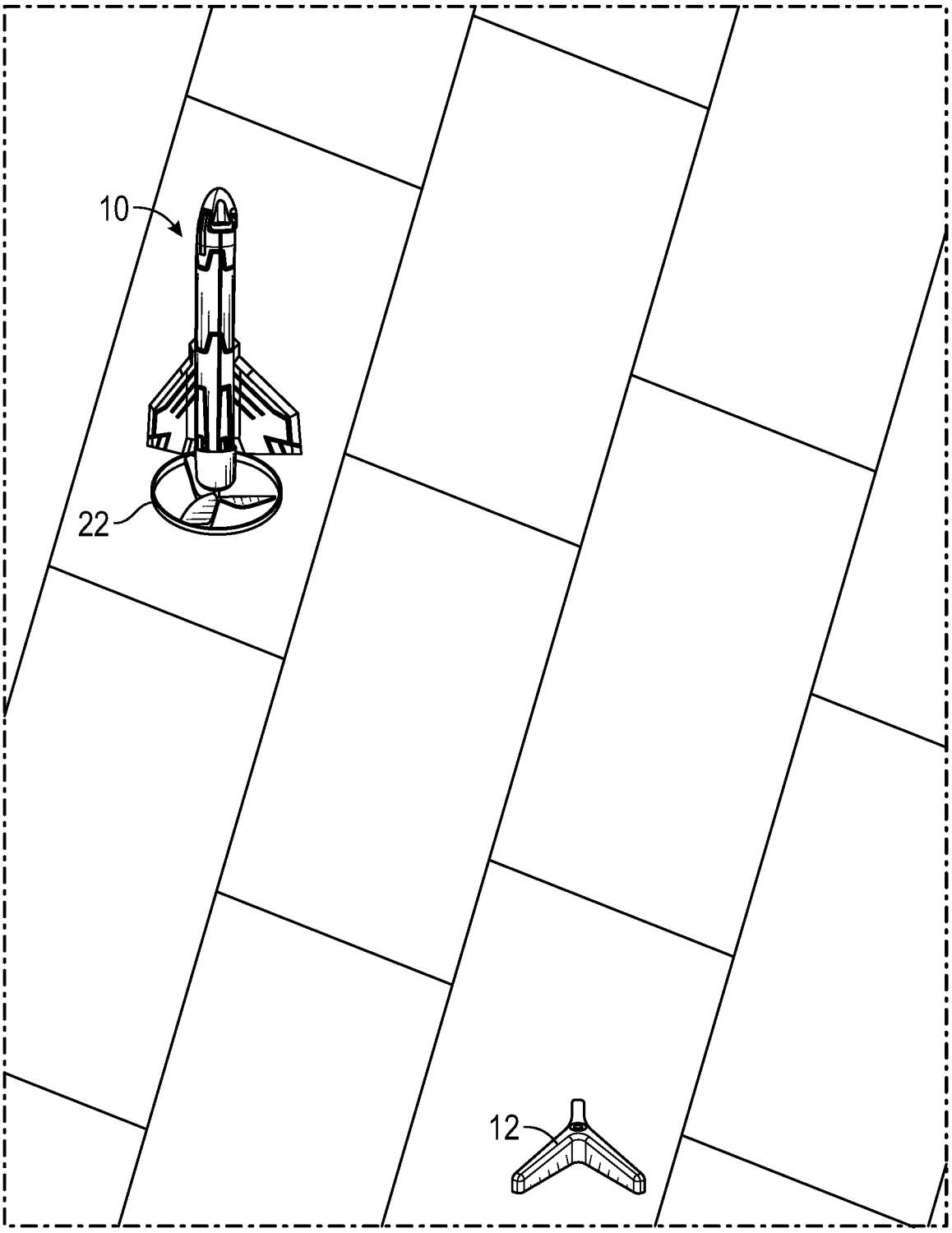
FIG. 7 is a perspective view of the rocket of FIG. 1 in flight.

A nosepiece 26 is connected to the base assembly 24 with an elongated connector 60. A plurality of body pieces 14, 16, 18 are disposed between the nosepiece 26 and the base assembly 24. In some embodiments, the body pieces 14, 16, 18 may cover all or some of the nosepiece 26 and the base assembly 24 when the body pieces 14, 16, 18 are in the stowed or launch position. The plurality of body pieces 14, 16, 18 are movable between a first position (the stowed or launch position), with each of the plurality of body pieces 14, 16, 18 disposed adjacent the elongated connector 60 to form a rocket-shape (see FIG. 6), and a second position, with each of the plurality of body pieces 14, 16 18 disposed at an angle away from the nosepiece 26 (see FIG. 9). At least one fin 20 extends outward from each of the plurality of body pieces 14, 16, 18, wherein each fin 20 is angled relative to horizontal (when the body pieces 14, 16, 18 are deployed in the second position) to cause the rocket to rotate during descent when in the second position.

The motor 32 turns in a first direction, creating the force to propel the rocket, where the first direction maintains the plurality of body pieces in the first position. The motor 32 is operable to turn in a second direction, which provides torque to permit the plurality of body pieces to deploy into the second position.

Figure 2:
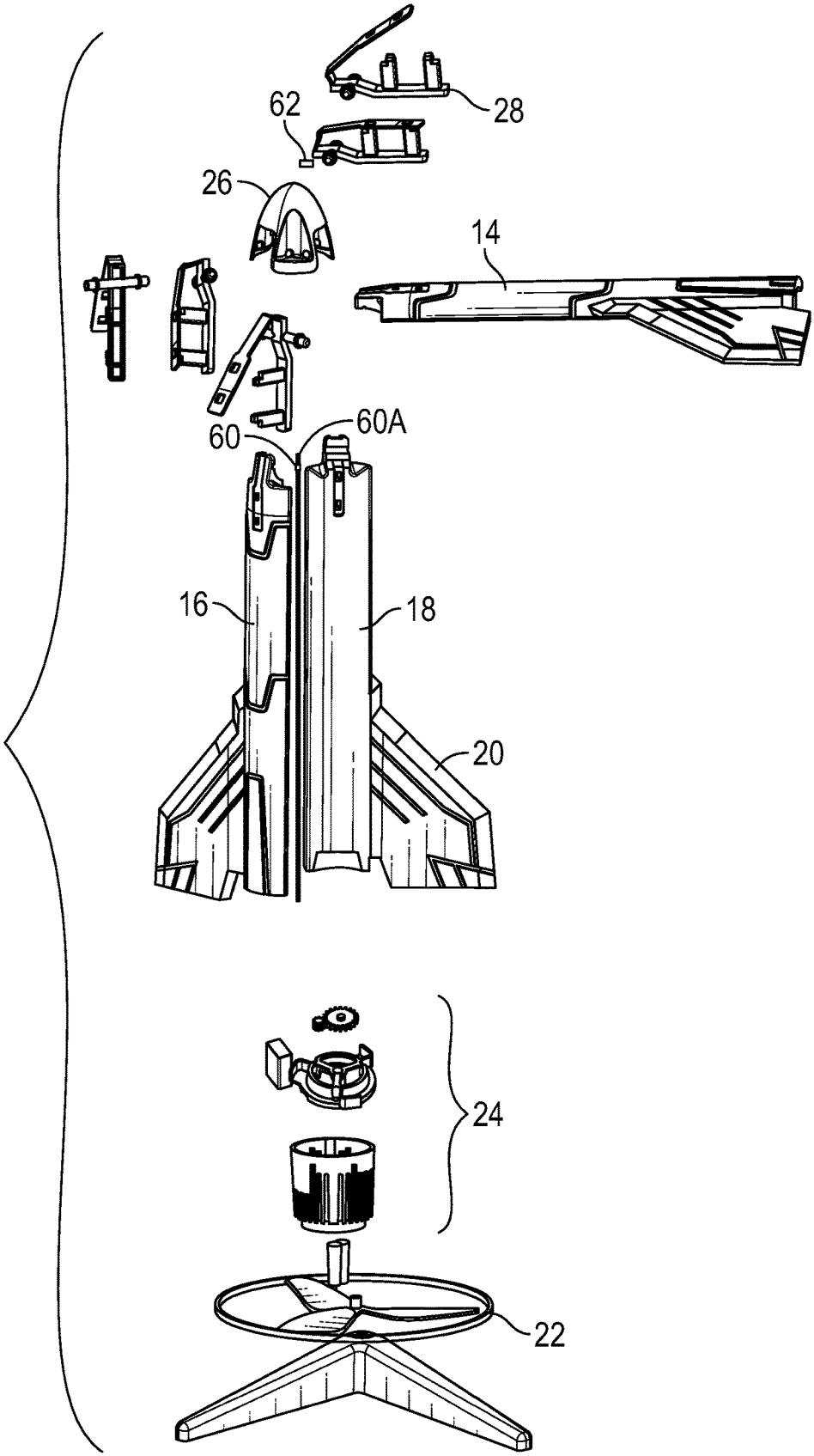
FIG. 2 is an exploded side perspective view of the rocket of FIG. 1.

A hinge 28 can connect each of the plurality of body pieces to the nosepiece. The hinge 28 can include a hinge pin 58 defining an axis of rotation, where the plurality of body pieces 14, 16, 18 rotate on respective ones of the axis of rotation when moving between the first position and the second position. In some embodiments, the hinge 28 can clip onto the plurality of body pieces 14, 16, 18. In FIG. 2, each hinge 28 is shown in an open and closed form, where, when open, the hinge 28 can clamp onto the body pieces 14, 16, 18 and pivot about the hinge pin 58 (axis of rotation). It should be understood that, in FIG. 2, only one hinge 28 is used per each of the plurality of body pieces 14, 16, 18.

In some embodiments, a first end 58B of the hinge pin 58 is offset from a central axis 60A of the rocket a distance greater than a distance the second end 58A of the hinge pin 58 is offset from the central axis of the rocket. In other words, the hinges 28 may be offset so that the plurality of body pieces 14, 16, 18 open at an angle, rather than completely orthogonal, with respect to the central axis 60A.

In some embodiments, the motor 32 can be powered by a battery 44. The battery 44 may be a rechargeable battery and a power port 51 may be provided for charging the rechargeable battery. In some embodiments, the plurality of body pieces can include solar energy collectors that can be used to charge the battery 44.

In some embodiments, a circuit board 46 is provided. The circuit board 46 can include a launch button 47 to begin launch of the rocket. When the user depresses the launch button 47, the battery 44 can energize the motor 32 to begin rotation of the launch propeller 22. In some embodiments, the circuit board 46 may be programmed to provide a delay, such as 5 or 10 seconds, from when the launch button 47 is depressed until when the motor 32 is energized, allowing the user to move away before the launch propeller 22 begins rotation.

In some embodiments, the circuit board 46 can include a processor 49 programmed to run the motor 32 in the first direction for a first period of time and then run the motor 32 in the second direction for a second period of time. The first period of time may be, for example, from 15 seconds to two minutes or longer. The second period of time may be from about 0.5 to about 10 seconds. When the motor 32 turns in the second direction, the plurality of body pieces are allowed to pivot away to form a descent propeller, as discussed in greater detail below. In some embodiments, the processor 49 may be programmed to run the motor in the first direction after running in the second direction for the second period of time, wherein running the motor in the first direction causes the rocket to slow its descent or hover for a period of time.

In some embodiments, a pin 42 extends from a bottom end of the rocket. The pin 42 can fit into a launching stand 12, permitting the rocket to be generally vertical for launch. In some embodiments, the launching stand 12 may be angled to allow the rocket to launch at an angle relative to vertical. Typically, this angle would be less than 45 degrees (relative to vertical) for safety to bystanders.

Figure 3:
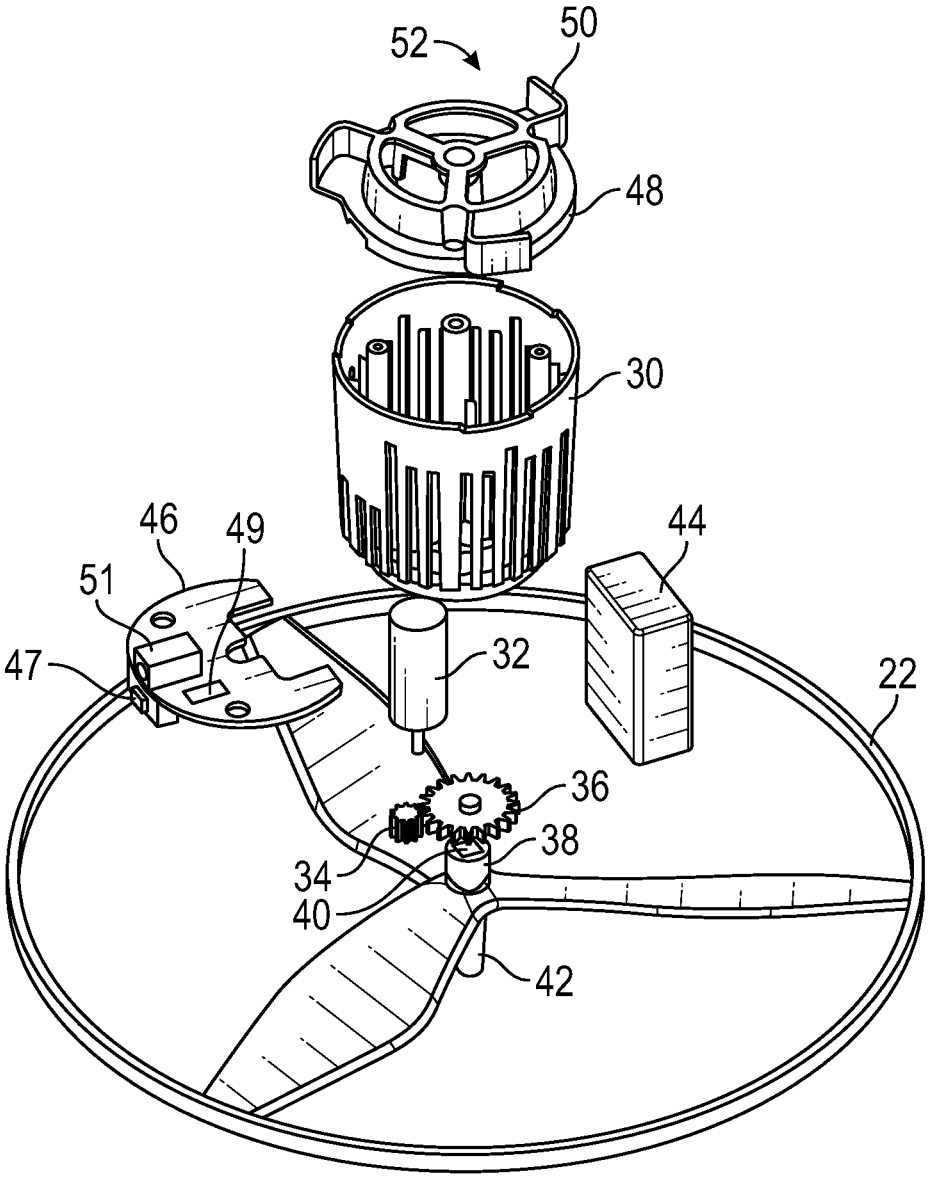
FIG. 3 is a detailed exploded perspective view of a base assembly of the rocket of FIG. 1.
Figure 4:
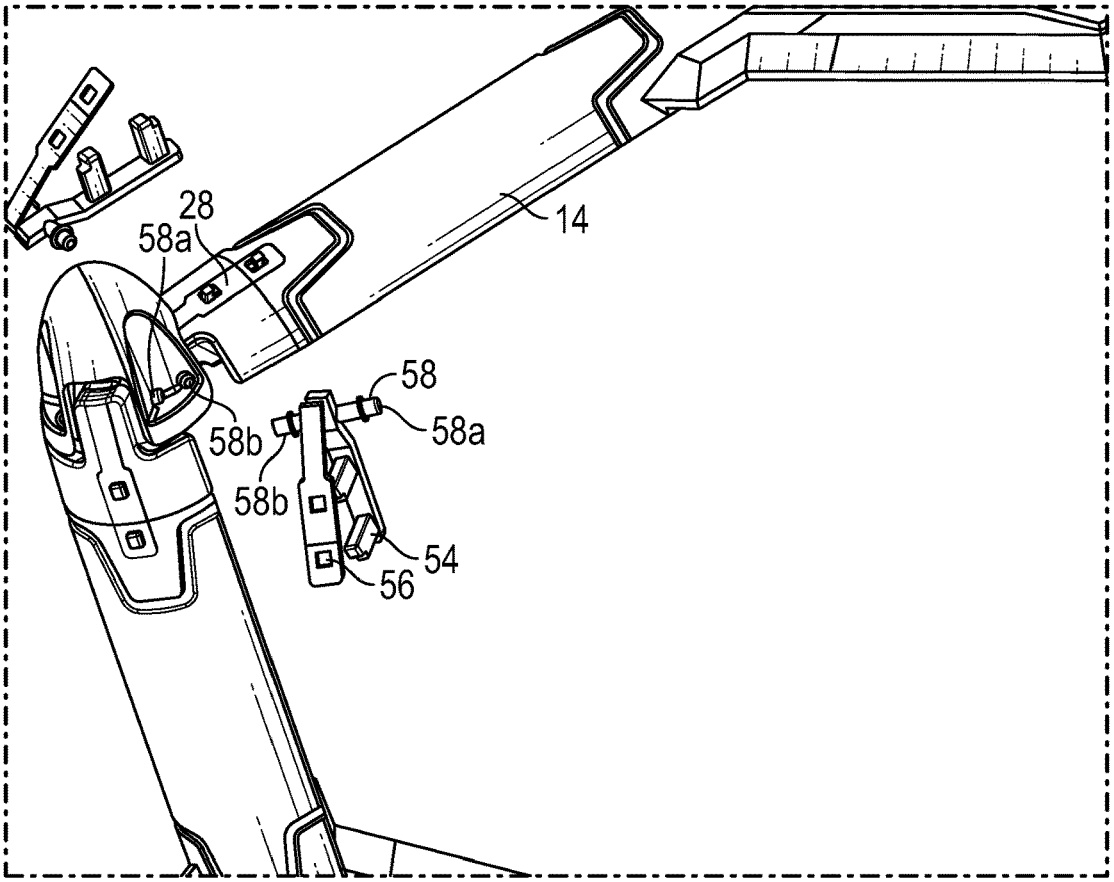
FIG. 4 is a detailed, partially exploded perspective view of a nose end of the rocket of FIG. 1.
Figure 5:
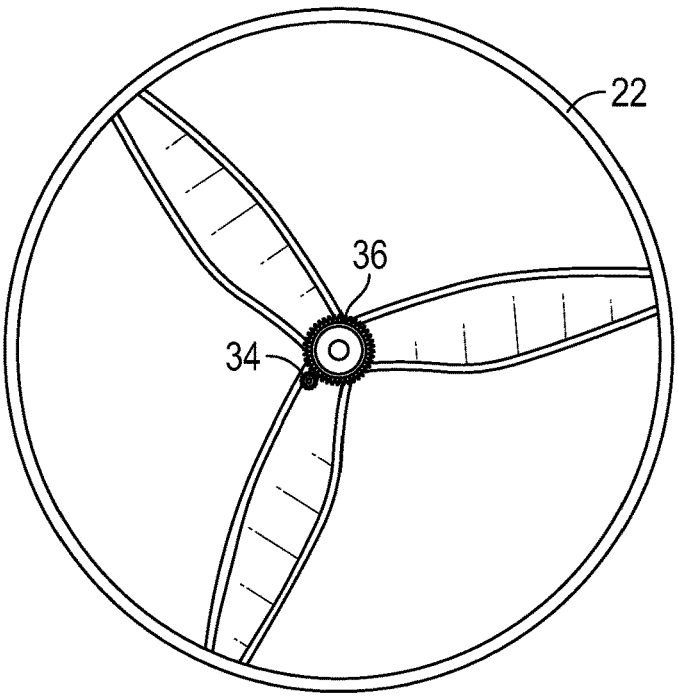
FIG. 5 is a top view of the propeller mechanism of the rocket of FIG. 1.

As best seen in FIG. 3, the motor 32 can drive a drive gear 34 that is offset from a central axis 60A of the rocket. The drive gear 34 can drive a driven gear 36 connected to the propeller 22. Thus, as the motor 32 turns, the propeller 22 can turn accordingly. A gearing ratio between the drive gear 34 and the driven gear 36 may vary to provide greater torque or speed, depending on the particular application.

In some embodiments, a body piece retainer 48 is used to retain the plurality of body pieces 14, 16, 18 into the first (stowed, launch) position. The body piece retainer 48 can have a plurality of slots 52 for retaining the plurality of body pieces 14, 16, 18 in the first position. The body piece retainer 48 can be movable to release the plurality of body pieces 14, 16, 18 from respective ones of the plurality of slots 52 when the motor 32 moves in the second direction, permitting the plurality of body pieces 14, 16, 18 to move to the second position.

In some embodiments, a sensor 62 can be used to determine when an apex of rocket flight is reached, at which time the motor 32 can change from the first direction to the second direction. In other embodiments, a predetermined amount of time is used prior to motor reversal.

Figure 8:
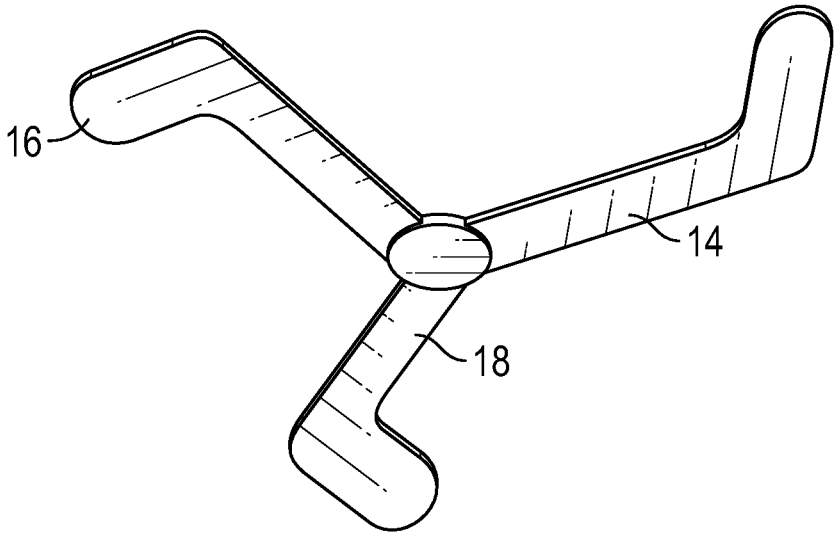
FIG. 8 is a bottom perspective view of the descent propellers deployed for a controlled descent.
Figure 9:
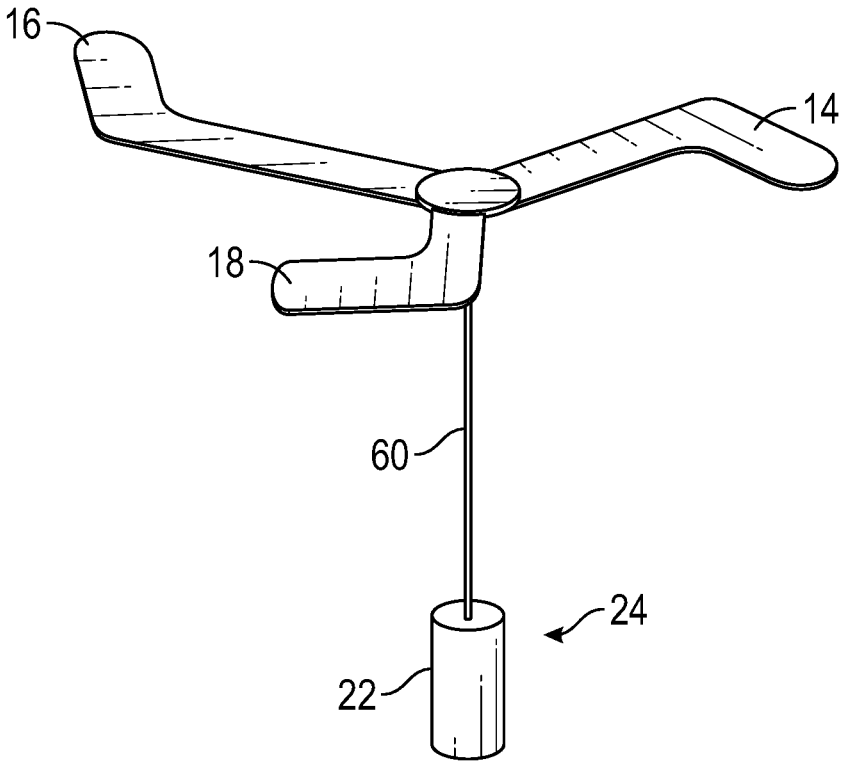
FIG. 9 is a schematic representation of the rocket of FIG. 1 during descent.

During operation, as shown in FIGS. 6 through 9, the rocket can be placed on the launching stand and the user can depress the button. The motor turns the launch propeller to propel the rocket upward. At a given point, the motor can quickly change directions, releasing the plurality of body pieces from being in the first position, to the second position. In some embodiments, the second position can position the plurality of body pieces at an angle away from the nose piece from about 80 to about 100 degrees. When the plurality of body pieces are in the second position (as shown in FIGS. 8 and 9), the pieces, along with their associated fins, help slow the descent of the rocket back to the ground.

While a particular form of the invention has been illustrated and described, it will be apparent that various modifications can be made without departing from the spirit and scope of the invention. For example, the same torque reaction (reversal of the motor) can be used to deploy a parachute, drop a payload from the rocket, eject a toy pilot from a toy aircraft, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A rocket comprising:

a propeller;

a base assembly supporting the propeller;

a motor in the base assembly, the motor operable to turn the propeller to provide a force to propel the rocket;

a nosepiece connected to the base assembly with an elongated connector;

a plurality of body pieces disposed between the nosepiece and the base assembly, the plurality of body pieces movable between a first position, with each of the plurality of body pieces disposed adjacent the elongated connector to form a rocket-shape, and a second position, with each of the plurality of body pieces disposed at an angle away from the nosepiece; and a fin extending outward from each of the plurality of body pieces, wherein each fin is configured to cause the rocket to rotate during descent when the plurality of body pieces are in the second position, wherein the motor turns in a first direction, creating the force to propel the rocket, the first direction maintaining the plurality of body pieces in the first position; and the motor turns in a second direction to provide torque to permit the plurality of body pieces to deploy into the second position.

2. The rocket of claim 1, further comprising a hinge connecting each of the plurality of body pieces to the nosepiece.

3. The rocket of claim 2, wherein each hinge includes a hinge pin defining an axis of rotation, where the plurality of body pieces each rotate about a respective axis of rotation when moving between the first position and the second position.

4. The rocket of claim 3, wherein a first end of the hinge pin is offset from a central axis of the rocket a distance greater than a distance a second end of the hinge pin is offset from the central axis of the rocket.

5. The rocket of claim 1, further comprising a battery providing power to the motor.

6. The rocket of claim 5, further comprising a circuit board having a launch button to begin launch of the rocket, the circuit board further including a processor programmed to run the motor in the first direction for a first period of time and then run the motor in the second direction for a second period of time.

7. The rocket of claim 6, wherein the processor is further programmed to run the motor in the first direction after running in the second direction for the second period of time, wherein running the motor in the first direction causes the rocket to slow its descent or hover for a period of time.

8. The rocket of claim 1, further comprising a pin extending from a bottom end of the rocket, the pin fitting into a launching stand.

9. The rocket of claim 1, wherein the motor drives a drive gear offset from a central axis of the rocket.

10. The rocket of claim 9, wherein the drive gear drives a driven gear connected to the propeller.

11. The rocket of claim 1, further comprising a body piece retainer having a plurality of slots for retaining the plurality of body pieces in the first position, the body piece retainer movable to release the plurality of body pieces when the motor moves in the second direction, permitting the plurality of body pieces to move to the second position.

12. The rocket of claim 1, further comprising a sensor for determining when an apex of rocket flight is reached, at which time the motor changes from the first direction to the second direction.

13. The rocket of claim 1, wherein the angle that the plurality of body pieces is disposed away from the nosepiece is from 80 to 100 degrees.

14. A rocket comprising:

a propeller;

a base assembly supporting the propeller;

a motor in the base assembly, the motor operable to turn the propeller to provide a force to propel the rocket;

a nosepiece connected to the base assembly with an elongated connector;

a plurality of body pieces disposed between the nosepiece and the base assembly, the plurality of body pieces movable between a first position, with each of the plurality of body pieces disposed adjacent the elongated connector to form a rocket-shape, and a second position, with each of the plurality of body pieces disposed at an angle away from the nosepiece;

a hinge connecting each of the plurality of body pieces to the nosepiece;

a fin extending outward from each of the plurality of body pieces, wherein each fin is configured to cause the rocket to rotate during descent when the plurality of body pieces are in the second position;

a battery providing power to the motor;

a body piece retainer having a plurality of slots for retaining the plurality of body pieces in the first position when the motor turns in a first direction, the body piece retainer movable to release the plurality of body pieces when the motor moves in a second direction, permitting the plurality of body pieces to move to the second position; and a circuit board having a launch button to begin launch of the rocket, the circuit board further including a processor programmed to run the motor in the first direction for a first period of time and then run the motor in the second direction for a second period of time.

15. The rocket of claim 14, further comprising a pin extending from a bottom end of the rocket, the pin fitting into a launching stand.

16. The rocket of claim 14, wherein the motor drives a drive gear offset from a central axis of the rocket, wherein the drive gear drives a driven gear connected to the propeller.

* * * * *